US006397721B1

(12) United States Patent
Murello

(10) Patent No.: US 6,397,721 B1
(45) Date of Patent: Jun. 4, 2002

(54) CARTRIDGE FEED DEVICE FOR A REPEATING FIREARM

(75) Inventor: Johannes Murello, Deisslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/992,449

(22) Filed: Nov. 16, 2001

Related U.S. Application Data

(63) Continuation of application No. 09/248,501, filed on Feb. 10, 1999.

(30) Foreign Application Priority Data

Feb. 10, 1998 (DE) ..... 198 05 297

(51) Int. Cl.[7] ..... F41A 9/00
(52) U.S. Cl. ..... 89/33.1; 42/17
(58) Field of Search ..... 42/17, 49.01; 89/33.1, 89/33.01

(56) References Cited

U.S. PATENT DOCUMENTS 2,132,761 A * 10/1938 Robertson ..... 42/21
3,611,608 A * 10/1971 Seiberling ..... 42/17
3,740,884 A * 6/1973 Wilhelm ..... 42/17
4,207,797 A * 6/1980 Gyorik ..... 89/34
4,389,918 A * 6/1983 Peck ..... 89/34
4,676,138 A * 6/1987 Thompson et al. ..... 89/33.14
4,867,039 A * 9/1989 Dobbins ..... 89/127
5,227,578 A * 7/1993 Reynolds ..... 89/186
5,367,810 A * 11/1994 Stead et al. ..... 42/17

* cited by examiner

*Primary Examiner*—Charles T. Jordan
*Assistant Examiner*—Michelle Thomson
(74) *Attorney, Agent, or Firm*—Marshall, Gerstein, & Borun.

(57) ABSTRACT

In an automatic firearm, a cartridge feed device is provided in order to convey the uppermost cartridge in a magazine into an intermediate station transverse to its extent. A lifting device is used to grasp the cartridge in the intermediate station and to move it vertically into a feed station in which it is aligned parallel to the axis of the barrel of the weapon. The lifting device is implemented as a feed fork having prongs which engage the cartridge in the intermediate station from the front and which then lift the cartridge into the feed station in a tilting movement.

10 Claims, 4 Drawing Sheets

1
27
12
29
2
13
17
11
28
12

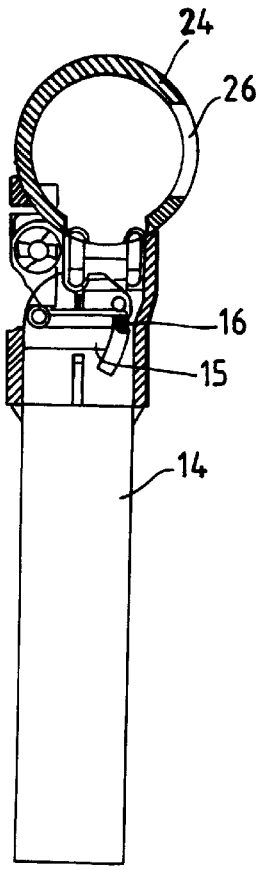
FIG. 4c
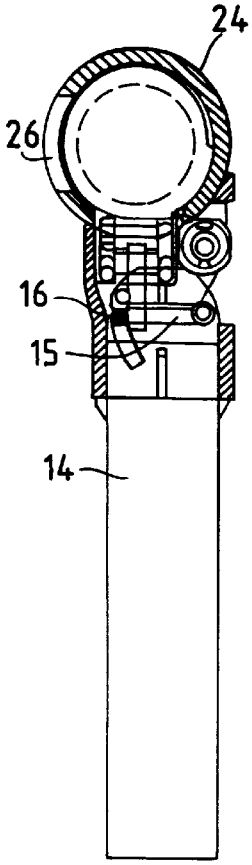
FIG. 4a
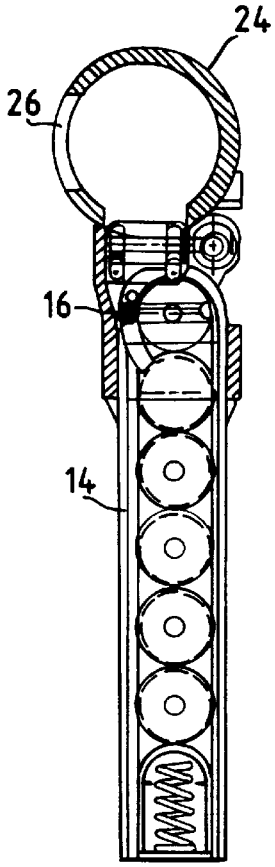
FIG. 4b
FIG. 6
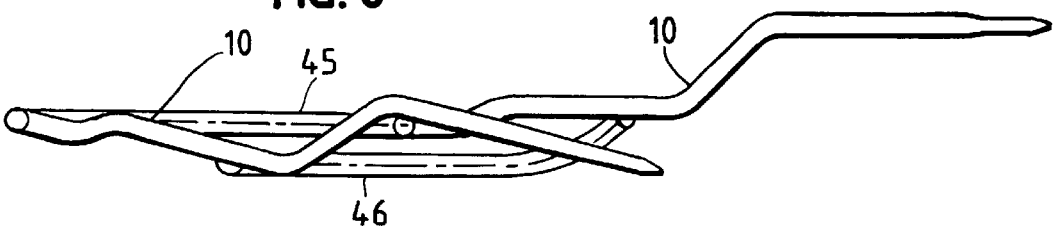
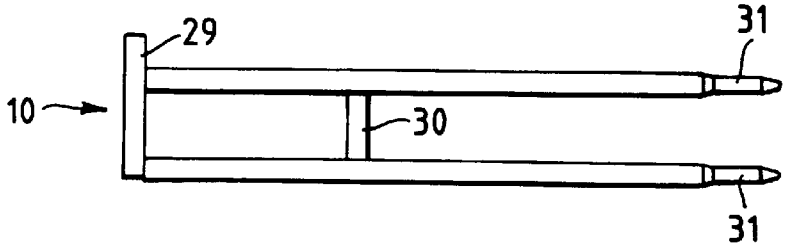
FIG. 7

CARTRIDGE FEED DEVICE FOR A REPEATING FIREARM

RELATED APPLICATION

This is a continuation of U.S. application Ser. No. 09/248,501, filed Feb. 10, 1999.

FIELD OF THE INVENTION

The invention relates generally to firearms, and, more particularly, to a cartridge feed device for a repeating firearm.

BACKGROUND OF THE INVENTION

When position designations, like "above", "in front of" or the like are used in the following, it is assumed that the described weapon is held in the normal firing position, in which the barrel lies horizontally. "Forward" then points in the direction of shooting. As used herein, the phrase "axis of the bore" is understood to mean the longitudinal axis of the barrel, which coincides with the longitudinal direction of the weapon.

In conventional automatic weapons employing a clip magazine, the uppermost cartridge in the magazine is forced from below against the closed breech. When the breech is opened, the uppermost cartridge moves slightly upward, where it is held by at least one magazine lip. Subsequently, the cartridge is grasped on the bottom by the closing breech and pushed forward. When pushed forward, the projectile of the cartridge mounts an oblique surface. The cartridge reaches the cartridge chamber after passing over a flat, upwardly directed S curve. The transfer position in the magazine thus coincides with the feed position in front of the cartridge chamber. The flatter the oblique surface, the longer the zone accommodating the oblique surface must be. Also, the steeper the oblique surface, the greater the mechanical load the projectile will experience during transfer of the cartridge. Additionally, the larger the cartridge diameter, the longer the zone accommodating the oblique surface must be. A significant increase in the total length of the weapon is, therefore, produced for cartridges with overall large dimensions and a sensitive projectile.

For these reasons, conventional shotguns employ a tubular magazine arranged parallel to their barrel instead of an ordinary bar magazine. In such weapons, the lowermost cartridge of the tubular magazine is pushed at the end of the magazine onto a loading spoon situated beneath the breech. The loading spoon swivels upward with the cartridge when the breech is opened. When the breech closes, the cartridge is pushed upward over the flat slope of the loading spoon and is pushed into the cartridge chamber linearly, although sloped obliquely to the barrel axis. The fact that the loading spoon also requires a zone extending over the length of the cartridge is still a shortcoming. A tubular magazine is generally also essential in this type of feed device.

On the other hand, in feed devices for advancing a cartridge, a space is required between the open breech and the rear edge of the barrel. This space may only slightly exceed the length of the cartridge. Prior art feed devices employing this approach are also the most gentle for the projectile, because the cartridge is initially brought to the same height as the cartridge chamber and then pushed into the chamber by the breech. The projectile then does not touch any part of the weapon. These feed devices were employed in the early days of automatic weapons (Vetterli, Henry), but have since been forgotten. In this type of device, a lifting block is provided behind a tubular magazine. The lifting block can be moved transversely to the magazine and has a receiving hole for a cartridge. When the breech is closed, this receiving hole is flush behind the tubular magazine so that the uppermost cartridge can be pushed rearward into the receiving hole, which, thus, forms a transfer station. If the breech is opened, the fired cartridge is first ejected and then, with the breech almost open, the lifting block is moved upward so that the cartridge now sits precisely behind the cartridge chamber in its feed station. On closure of the breech, the breech enters the receiving hole from the rear and pushes the cartridge directly into the cartridge chamber. Immediately before closure of the breech, the lifting block retracts downward. Since the receiving hole has a slit on the top corresponding to the width of the breech, the lifting block can be moved downward, even when the breech passes through the receiving hole.

These prior art feed devices are not without problems because the mushroom head must have a smaller diameter than the receiving hole if one wishes to exploit the aforementioned advantage of minimal design length of the weapon. Moreover, as in the aforementioned feed device with the loading spoon, a tubular magazine is generally required. However, in a tubular magazine the cartridges are supported with their bottom on the projectile of the subsequent cartridge. This arrangement can cause damage to the projectiles. Additionally, rapid advance of the cartridge is generally only possible when the cartridges are advanced in succession, say in a belt, a clip magazine or the like. Replaceable tubular magazines have been known from the earliest days of automatic weapons, but have not proven themselves at all.

SUMMARY OF THE INVENTION

In accordance with one aspect of the invention, a cartridge feed device having a transfer station, an intermediate station, and a feed station is provided. The transfer station is arranged beneath or next to the intermediate station. The cartridge feed device includes a feed mechanism which functions to release a cartridge from the transfer station and to convey the released cartridge to the intermediate station. The cartridge feed device also includes a lifting device which can be moved longitudinally in the direction of the axis of the bore and which is arranged to grasp the cartridge in the intermediate station before lifting the cartridge to the feed station.

In accordance with another aspect of the invention, a cartridge feed device is provided for use with a repeating small arm which is equipped with a barrel and a moveable breech. The cartridge feed device includes a magazine to feed cartridges from below or from the side. It also includes a transfer device to release and convey the fed cartridge to an intermediate station. The cartridge feed device also includes a lifting device to convey the cartridge from the intermediate station to a feed station wherein the cartridge is located behind the cartridge chamber of the barrel. The lifting device is movable in the direction of the barrel axis and underpins the cartridge in the intermediate station.

Other features and advantages are inherent in the apparatus claimed and disclosed or will become apparent to those skilled in the art from the following detailed description and its accompanying drawings.

BRIEF DESCRIPTION OF THE DRAWINGS

FIGS. 3*a* to 3*m* illustrate the control piece and control shaft of the cartridge feed device of FIGS. 1 and 2 in successive phases of their movements.

FIGS. 4*a* to 4*c* are longitudinal sectional views through the weapon and magazine of FIGS. 1 and 2 shown with and without the cartridge and viewed from the front and from the rear.

FIGS. 5*a*' to 5*c*' illustrate a front view of the top of the magazine in the movement states corresponding to FIGS. 5*a* to 5*c*.

FIG. 6 is a side view of the feed fork of the feed device of FIG. 1 shown in its two end positions.

FIG. 7 is a top view of the feed fork in the feed station.

In the interest of clarity, the drawings of the disclosed feed device are schematic in nature and are restricted to the essential parts needed to understand the disclosed implementation.

DESCRIPTION OF THE PREFERRED EMBODIMENTS

Figure 1:
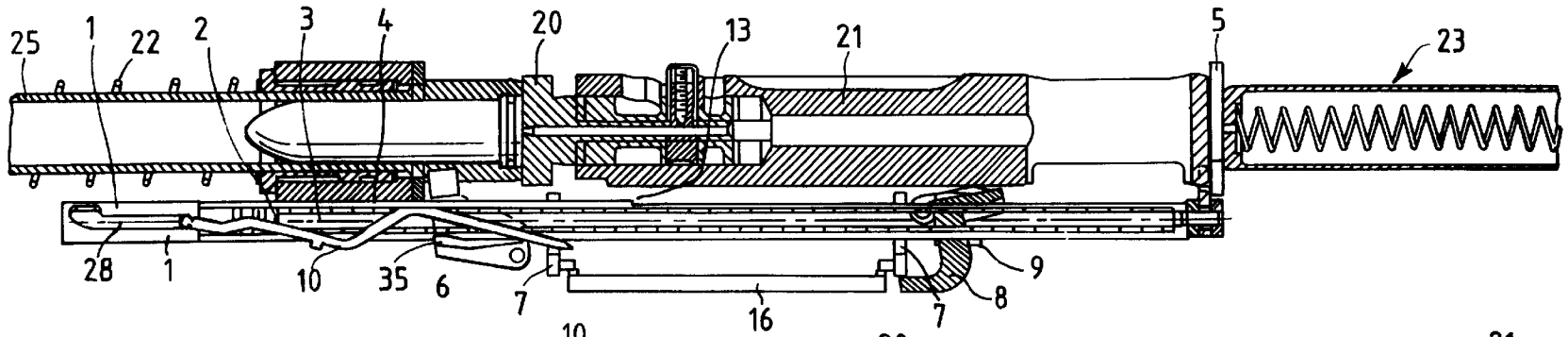
FIG. 1 is a longitudinal sectional view through a large caliber automatic weapon equipped with a cartridge feed device constructed in accordance with the teachings of the invention and shown in the ready-to-shoot state (i.e.,the base position).

The weapon depicted partially in FIG. 1 is a large caliber automatic weapon with a titanium barrel 25. The barrel 25 is mounted to move lengthwise in a weapon housing 24. The barrel 25 is biased into its front position (FIG. 1) by a barrel spring 22. A control shaft 2 is mounted adjacent the barrel 25 as explained in detail below. A safety lever 6 is provided near the distal end of the control shaft 2. The safety lever 6 is adapted to selectively engage the control shaft 2 to preclude longitudinal movement of the shaft 2 at certain times as discussed below. During certain movements, the barrel 25 interacts with the safety lever 6 to force the safety lever 6 out of engagement with the control shaft 2.

Figure 2:
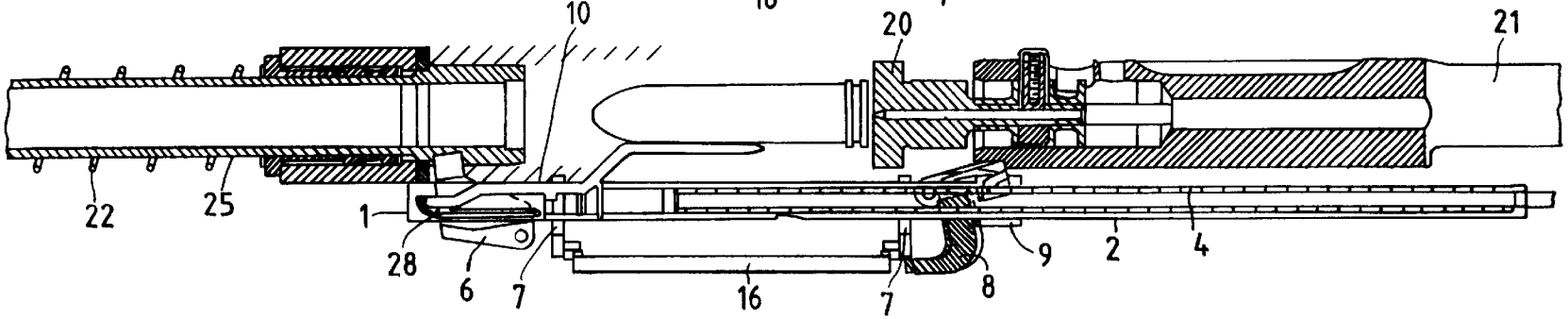
FIG. 2 is a view similar to FIG. 1, but showing the weapon with an open breech and a cartridge situated in the feed station.

A breech sits behind the barrel 25. The breech comprises a mushroom head 20 and a breech block carrier 21. The mushroom head 20 is mounted to rotate in the breech block carrier 21. The breech block carrier 21 is positioned behind the mushroom head 20 as shown in FIGS. 1 and 2. The mushroom head 20 can enter into locking engagement with the barrel 25. The breech block carrier 21 is loaded forward by a locking spring device 23, which in turn is equipped with an oil pressure damper (not shown). A catch lever 8 is mounted beneath the movement path of the breech block carrier 21. The catch lever 8 can engage with the breech block carrier 21 in order to secure the carrier 21 in its rearmost position (shown in FIG. 2).

After a shot is fired, the barrel 25, which at this time will be rigidly locked to the mushroom head 20 and, thus, also to the breech block carrier 21, moves rearward together with the breech. This movement of the barrel 25 causes the safety lever 6 to immediately release the control shaft 2. The breech block carrier 21 is held in its rearmost position at the end of the motion path by the catch lever 8, while the barrel 25 is moved forward again by the barrel spring 22. The breech unlocks by rotating the mushroom head 20. The spent cartridge casing is then extracted from the cartridge chamber of the barrel 25 and ejected. Reloading can now occur, which is described in detail below.

Since all dimensions in the depicted weapon are quite large, the longitudinal spacing between the rear end of the barrel 25 when the barrel 25 is situated in its front position and the front end of mushroom head 20 when the mushroom head 20 is situated in its rear position must be as short as possible. Moreover, the cartridge for this type of weapon is sometimes provided with a very sensitive projectile equipped with electronic elements. Therefore, in such weapons, the projectile must not encounter any obstacles during the reloading process. As discussed above, conventional automatic weapons employing a clip magazine often present the projectiles of the advancing cartridge with obstacles for the purpose of advancing the projectile in an angled motion path from the magazine into the cartridge chamber. The shorter the path available for advancing the cartridge and the longer the vertical distance that must be covered by the cartridge during such advancing, the greater the likelihood that hangups will occur.

In order to keep the longitudinal distance as short as possible, in the illustrated weapon, the uppermost cartridge in the magazine 14 (see FIG. 4*b*) (i.e., the cartridge in the transfer station) is not directly grasped by the mushroom head 20 and pushed out of the magazine 14. Instead, the cartridge is initially conveyed upward into an intermediate station (i.e., the position occupied by the cartridge shown with a dashed line in FIG. 5*c*) and is there engaged by a feed fork 10 from the front. The feed fork lifts the cartridge upward into a feed station where it supports the cartridge such that the longitudinal axes of the barrel 25 and the cartridge coincide. The weapon housing 24 is then situated above the cartridge so that the cartridge cannot fall out (even with the weapon held over the head). The cartridge cannot possibly fall out of the ejection opening 26 (FIG. 4*a*), because an arm of the feed fork 10 partially blocks the opening 26. Release of the breech block carrier 21 by the catch lever 8 and movement of the feed fork 10 occur independently of the speed of the breech during opening of the breech and are adjusted to each other so that the cartridge does not linger in the feed station, but is instead immediately grasped by the end surface of the mushroom head 20 on reaching the feed station and is then pushed into the cartridge chamber. Even if the weapon housing 24 were not present, the reloading process would therefore occur free of disturbance even in a weapon held obliquely, vertically or over the head.

The motion process of the individual components will now be explained in detail. Their design and arrangement are first described for this purpose.

A hollow control shaft 2 is mounted obliquely beneath the motion path of the barrel 25 and the breech 20, 21. The control shaft 2 preferably has flattened sides and is arranged parallel to the barrel 25 and breech 20, 21. The shaft 2 is mounted to both rotate and move longitudinally. When in the base position (FIG. 1), the control shaft 2 extends roughly from the backside of the breech block carrier 21 to roughly the front end of the cartridge chamber. The control shaft 2 has a control edge 13 on its outer periphery. The control edge 13 is located roughly in the center of the length of the shaft 2. A catch edge 35 is situated in the front third of the shaft 2. The rear end of the control shaft 2 is open.

A cylindrical control piece 1 is rotatably mounted on the front end of the control shaft 2. The diameter of the control piece 1 corresponds to the diameter of the control shaft 2.

A tie rod 3 enters the rear open end of the hollow control shaft 2 and extends to close to its front end. There is peripheral play between the inner surface of the control shaft 2 and the tie rod 3. A coiled compression spring 4 is inserted into the shaft 2 around the tie rod 3 and inside of the control shaft 2. The spring 4 extends between the front and back ends of the tie rod 3. The rear end of tie rod 3 protrudes rearward from the control shaft 2 and is mounted on a dog 5. The dog 5 is fastened to the back side of the breech block carrier 21 and extends downward from it. When the breech block carrier 21 is moved rearward, it carries the tie rod 3 with it via dog 5. The rearward movement of the tie rod 3 in turn entrains either control shaft 2 via compression spring 4 or, when the control shaft 2 is inhibited from backward movement, loads and compresses the compression spring 4.

A slotted groove 17 is formed in the rear half of the outer wall of the control shaft 2 (shown in the development of FIGS. 3*a* to 3*m*). A control pin 11 engages in the slotted groove 17. The control pin 11 is fastened to the weapon housing 24. The front section of the slotted groove 17 is linear and extends parallel to the motion direction of the barrel 25, the breech 20, 21 and the control shaft 2. The rear section of the slotted groove defines a closed loop, which is arranged so that the control pin 11 passes through separate arms of the loop during forward and backward movements of the control shaft 2. If the control shaft 2 is moved forward and backward, the groove 17 runs along the fixed control pin 11 and in so doing executes a rotational movement coordinated with its longitudinal movement.

The feed device also includes pivotable unlocking arms 7 that are unmoveable in the longitudinal direction. One of the unlocking arms 7 is located in front of the transfer, intermediate and feed positions. The other one of the unlocking arms 7 is located behind the transfer, intermediate and feed positions. Each of the unlocking arms 7 is adapted to execute a synchronous pivoting movement when the control shaft 2 rotates. The lower end of the catch lever 8 interacts with the lower end of the rear unlocking arm 7. When the catch lever 8 engages in the motion path of the breech block carrier 21 and secures the carrier 21 in its rear position, the lower end of the catch lever 8 pivots out to thereby release the rear unlocking arm 7. A contact piece 9 cooperates with the catch lever 8. The contact piece 9 is moved by the control edge 13 of the control shaft 2. When the control shaft has reached its rear end position, the contact piece 9 disengages the catch lever 8 from the breech block carrier 21 so that the carrier 21 can move forward again.

The lower ends of the two unlocking arms 7 engage in a locking clamp 15, which is mounted to pivot on the front and rear side of the magazine 14. The two free ends of the locking clamp 15 are connected by a moving magazine lip 16. Therefore, when the unlocking arms 7 execute a pivoting movement, the pivoting motion is transferred to the locking clamp 15 which moves the moving magazine lip 16 downward in arc-like fashion in a motion path parallel to the motion path of the clamp 15 (FIG. 5). The movement of the magazine lip 16 releases the uppermost cartridge in the magazine 14 such that the uppermost cartridge is conveyed from the transfer station to the intermediate station. When the cartridge reaches the intermediate station, the unlocking arms 7 pivot back. This feed movement of the cartridge from the transfer station to the intermediate station is supported by the pushing effect of the magazine spring and by spring(s) which are connected to the locking clamps 15. This process is further explained below in connection with the discussion of the magazine 14.

The magazine 14 is a single-row clip magazine with a feed device which is loaded upwardly by a magazine spring positioned on the bottom of the magazine 14. The force of the magazine spring pushes the cartridges upward. The magazine 14 has a fixed magazine lip on the upper end. The fixed magazine lip arches upward from a magazine side wall to the center of the magazine 14, during which the inner curvature of the lip is complementary to the outer contour of a cartridge. The already mentioned moving magazine lip 16 lies beneath the upper edge of the fixed magazine lip on the other magazine side wall and can be pivoted downward and toward the center of the magazine. The filling opening for the cartridges does not, therefore, lie in the center of the magazine, but is instead offset laterally on the top of the magazine 14.

Figure 5A:
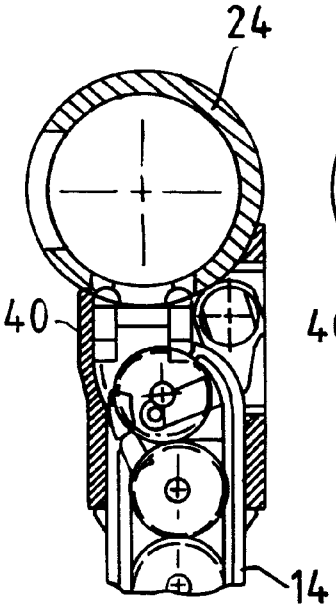
FIGS. 5*a* to 5*c* illustrate a section from FIG. 4*b* in different phases of the motion process of the feed device.
Figure 5B:
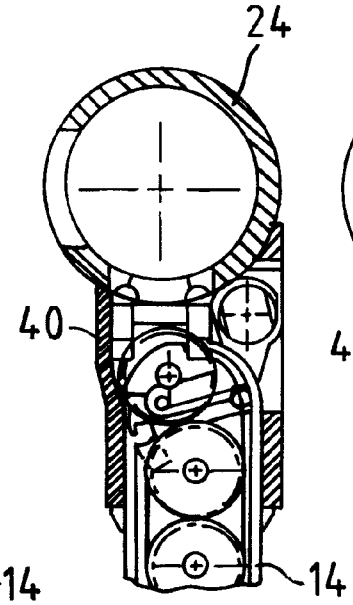
Figure 5C:
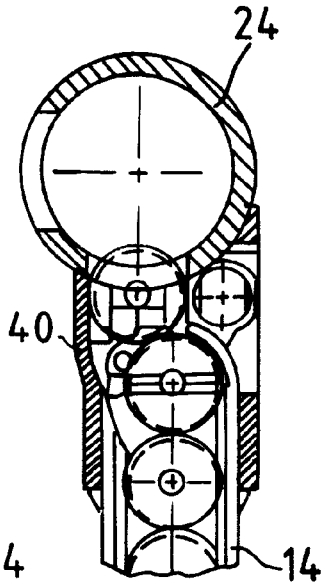
Figure 5A:
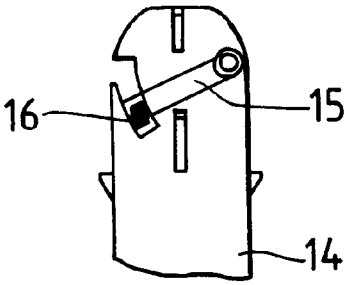
Figure 5B:
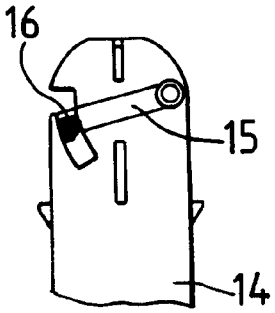
Figure 5C:
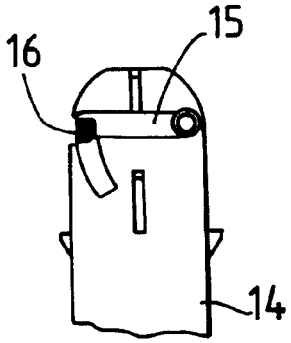

When filling the magazine 14, a cartridge is pressed into the filling opening (FIG. 5*a*) and the moving magazine lip 16 is then pivoted downward (FIG. 5*b*) until the cartridge can slide over the moving lip 16 and downward along the opposite magazine side wall. The moving magazine lip 16 then retracts into its upper position. If the cartridge is now released, it is forced upward by the feed device or magazine spring and is held by the moving magazine lip 16 and the fixed magazine lip such that the uppermost cartridge in the magazine (i.e., the most recently loaded cartridge) lies tightly against the curvature of the fixed magazine lip (FIG. 5*c*). To unload the magazine 14, a locking clamp 15 is released on the outside of the magazine 14 by pivoting the clamp 15 downward with a finger. The pivoting of the clamp 15 also pivots the moving magazine lip 16 such that the uppermost cartridge is released. The locking clamp 15 is then released by the user so that it pivots back to its original position. The uppermost cartridge is then pushed out, obliquely upward from the magazine 14 by the force of the magazine spring and, possibly, by the springs (not shown) associated with the locking clamps 15. Each of the described filling and unloading processes is repeated until the magazine 14 is filled or empty, to the extent desired by the user.

In order to lift the cartridge from the intermediate station into the feed station when the breech 20, 21 is open, a feed fork 10 is provided which functions as a lifting device. The feed fork 10 is arranged to move longitudinally and can be lifted by pivoting with its rear end from below the barrel 25 to the height of the cartridge chamber.

The illustrated feed fork 10 (FIG. 7) has two parallel prongs 31 which extend linearly in the longitudinal direction (top view) of the weapon, but are curved in the side view so that the rear section extends parallel to the front section but the rear section is displaced upward relative to the front section. The rear, free ends of the prongs 31 are tapered and rounded in order to facilitate engagement with a cartridge. The front ends of the prongs 31 are joined by a laterally protruding fork pin 29. Farther to the rear, but still in the front section, the two prongs 31 are connected by a cross piece 30.

The fork pin 29 and the cross piece 30 are restrained and guided during forward and backward movement of the feed fork 10, as clarified by the slotted elements 45, 46 shown in FIG. 6. These slotted elements 45, 46 need not be present by design, but can instead be implemented by other elements. Preferably the slotted element 45 in which the fork pin 29 runs extends linearly in the longitudinal direction of the weapon and is formed by the longitudinally moveable control piece 1. The lower slotted element 46 in which the cross piece 30 is guided is curved upward at its rear end. The cross piece 30 can protrude laterally above one or both prongs 31 to facilitate engagement with the slotted element. When the feed fork 10 traverses its motion path from front to back, it is moved from an initial position (shown on the left in FIG. 1 and in FIG. 6), in which the free ends of the prongs 31 lie beneath the fork pin 29, into an end position in which the free ends of the prongs 31 lie above the fork pin 29 and the front and rear sections extend roughly parallel to the longitudinal axis of the weapon.

The prongs 31 and the slotted elements and motion processes are coordinated with the fork pins 29 and cross piece 30 so that, in the front position or initial position of the feed fork 10, its rear, free ends lie beneath at least the projectile as well as in front of the cartridge associated with the projectile in the intermediate station. On the other hand, when the fork 10 is in the rear or end position, the rear sections of the prongs 31 fully engage beneath the cartridge and hold it in a position in which it is situated behind and precisely coaxial to the cartridge chamber (shown on the right in FIG. 2 and FIG. 6). The precise shape of the prongs 31 is then adjusted to the geometry of the cartridge so that the coaxial position of the cartridge relative to the cartridge chamber is guaranteed.

The control piece 1 is mounted to rotate on the front end of the control shaft 2, but is axially unmoveable with respect to the control shaft 2. Thus, the control piece 1 lengthens the control shaft 2 forward and follows the longitudinal movement, but not the rotational movement, of the control shaft 2.

The cylindrical control piece 1 has two slotted grooves extending essentially in a longitudinal direction on its outside, namely the control groove 27 and the fork groove 28. The control groove 27 extends to the front end of the control piece 1 and runs in a widened opening, whereas the fork groove 28 ends before the front end of the control piece 1 with a widened section that discharges forward. A control pin 12, which is attached permanently to the weapon housing 24, engages in the control groove 27. The fork pin 29 of the fork 10 engages and is guided in the fork groove 28.

The front and rear edges of the widened section of the fork groove 28 grasp and impart a longitudinal movement to the fork pin 29. On the other hand, the rear section of the fork groove 28 is adapted to pass over the resting fork pin 29. The widened discharge of control groove 27 runs onto the fixed control pin 12 during forward movement and rotates the control piece 1 so that the control piece 1 can be moved farther forward. During this additional forward movement, the rear part of the control groove 27 runs over the control pin 12.

The motion process of the aforementioned feed device will now be described with reference to FIG. 3 in which the control piece 1 and the control shaft 2 are shown in a development together with the fixed control pins 11 and 12 and the moving fork pin 29 in 11 successive phases.

Figures 3A, 3B, 3C, 3D, 3E, 3F, 3G, 3H, 3I, 3J, 3K, 3M:
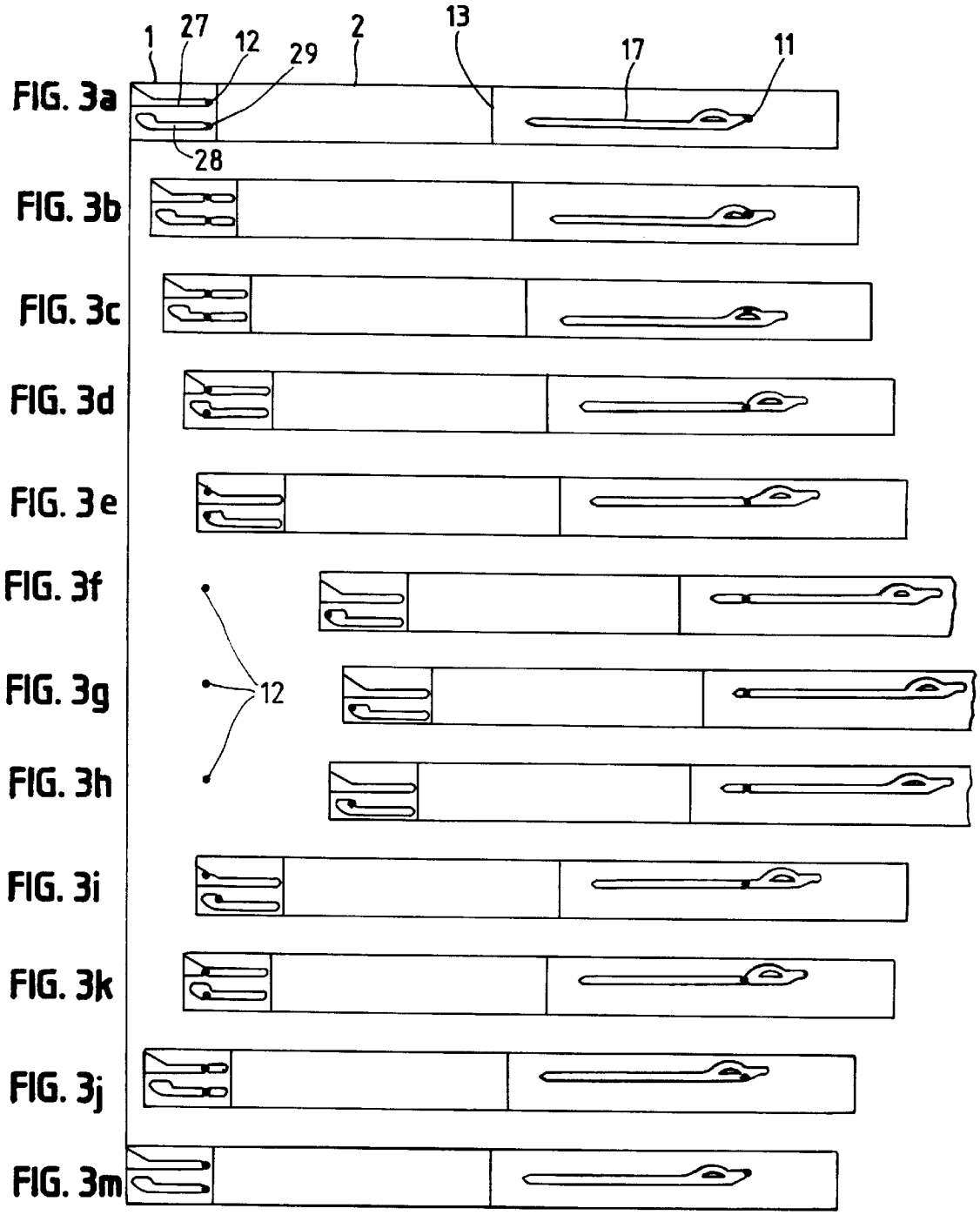

The base position shown in FIG. 1 corresponds to the depictions of FIGS. 3*a* and 3*m*. In the base position, the magazine 14 is in the position shown in FIG. 4*b*, in which the uppermost cartridge lies against the curve inside the fixed magazine lip and against the moving magazine lip 16 which is situated in its uppermost position. The magazine 14 also assumes this position outside the weapon. The feed fork 10 is situated in the position shown on the left in FIG. 6. The control piece 1 and, thus, the control shaft 2 are situated in their frontmost positions. The tie rod 3 is situated in its frontmost position. The compression spring 4 is, therefore, relieved. The breech 20, 21 is situated in its frontmost position. When a cartridge is situated in the cartridge chamber, it can be fixed. The control groove 17 sits with its rear end on the fixed control pin 11; the control groove 27 sits with its rear end on the fixed control pin 12; and the fork groove 28 sits with its rear end on the fork pin 29.

First motion phase (FIG. 3*b*):

If the cartridge is fired, then, as described above, the barrel 25 is initially moved to the rear together with the mushroom head 20 and the breech block carrier 21. If it is reloaded by hand, then the barrel 25 remains in its frontmost position. The dog 5 is moved rearward with breech block carrier 21 and pulls the tie rod 3 in a rearward direction. The tie rod 3, in turn, carries the control shaft 2 and the control piece 1 rearward via the compression spring 4, until the control shaft 2 with the core piece around which the loop of the control groove 17 runs, reaches the fixed control pin 11. Since the rear unlocking arm 7 is secured by the catch piece 8 and, in turn, is mounted to rotate in unison with the control shaft 2, the unlocking arms 7 cannot be rotated and remain fixed. As the breech 20, 21 retracts farther, it compresses the compression spring 4 via the dog 5 and the tie rod 3. The control groove 27 and the fork groove 28 also move in a rearward direction relative to the fixed control pin 12 and the fork pin 29. The fork pin 29 temporarily remains fixed.

Second motion phase (FIG. 3*c*).

When the breech block carrier 21 reaches its rearmost position, the catch piece 8 falls into engagement with the carrier 21 thereby releasing the rear unlocking arm 7. The control shaft 2 is now rotatable again and can pivot outward with the core piece as the rear fixed control pin 11 enters the loop of the control groove 17. The two unlocking arms 7 are thus pivoted, which in turn pivots the moving magazine lip 16 downward so that the uppermost cartridge in the magazine 14 is released and the next cartridge in the magazine 14 is secured (FIG. 5*a*). The full cartridge (during loading by hand) or the empty cartridge casing (after firing) is ejected. If the breech movement was triggered by a shot, the barrel 25 will have already moved forward again shortly before the ejection.

The tie rod 3 together with the dog 5 and the breech block carrier 21 reach their rear end position. Further rearward movement of the control piece 1 and the control shaft 2 is then caused by the force generated when the compressed compression spring 4 is released.

Third motion phase (FIG. 3*d*):

The loop of the control groove 17 has passed over the fixed control pin 11. The control shaft 2 has, thus, carried out a pivoting movement in the opposite direction but covered a larger angular range. The unlocking arms 7, therefore, also pivot back over an angular path that is larger then the previously covered angular path and the moving magazine lip 16 pivots back into its initial position (not farther, because it is secured there by a stop). The uppermost cartridge in magazine 14, which was engaged beforehand by the pivoted magazine lip 16, was in the meantime pushed slightly upward by the next cartridge or the magazine feed device (e.g., by the action of the magazine spring) and is now moved upward by the action of the magazine spring, supported by the spring of the moving magazine lip 16 (not shown) (FIG. 5*b*), until it has reached the intermediate station (FIG. 5*c*). The next cartridge now assumes the uppermost position in the magazine 14. A protrusion 40 of the weapon housing 24 relative to the fixed magazine lip permits the advanced cartridge to be moved upward past the fixed magazine lip.

Fourth motion phase (FIG. 3*e*):

During further backward movement of the control shaft 2, the rear control pin 11 runs in the forward, linear section of the control groove 17. This forward, linear section of the groove 17 runs parallel to the motion direction of the control shaft. The control shaft 2 is, therefore, not rotated further during its further backward movement. The control piece 1 runs with the forward, beveled end of the fork groove 28 against the fork pin 29 and can be rotated, since the control groove 27 of the control piece 1 with its widened inlet is situated above the forward, fixed control pin 12, which permits rotation of the control piece 1 within the path permitted by the expanded inlet.

Fifth motion phase (FIG. 3*f*):

The control shaft 2 runs rearward together with the control piece 1. The rearward movement of the control piece 1 carries the fork pin 29 of the feed fork 10 backward via the fork groove 28. The feed fork 10 then runs with its cross piece 30 along a slotted guide (see FIG. 6), such that the prongs 31 of the fork 10 engage the cartridge positioned in the intermediate station and lift it upward to almost the uppermost position, which is shown on the right in FIG. 6. The control edge 13 of the control shaft 2 carries the contact piece 9 with it.

Sixth motion phase (FIG. 3*g*):

The control piece 1 moves further rearward and lifts the feed fork 10 fully. The cartridge has reached the feed station, (i.e., the position shown in FIG. 2). The contact piece 9 pivots the catch lever 8 from engagement in the breech block carrier 21 which responds by beginning to move forward together with the mushroom head 20. The control piece 1 and the control shaft 2 reach their rearmost position. The movements of the mushroom head 20 and the feed fork 10 are adjusted to each other so that the already forward moving mushroom head 20 has almost reached the bottom of the cartridge when the cartridge reaches the feed station.

Seventh motion phase (FIG. 3*h*):

The mushroom head 20 has reached the bottom of the cartridge and begins to push it forward, while the feed fork 10 is still paused in its uppermost position. This is possible because the prongs 31 of feed fork 10 have reached the cartridge bottom (i.e., the rearward end of the cartridge). The dog 5, which is attached to breech block carrier 21, comes into contact with the end edge of the control shaft 2 and then pushes the control shaft forward. The rear end of the expansion of the fork groove 28 runs onto the fork pin 29 and begins to carry it forward together with the feed fork 10.

Eighth motion phase (FIG. 3*i*):

The feed fork 10 is carried forward by the fork groove 28 of the control piece 1 with the speed with which the mushroom head 20 is also moved forward together with the cartridge. The prongs 31 then pivot downward with their rear ends until the feed fork 10 again assumes its initial position (FIG. 6 left). The projectile tip of the cartridge enters the cartridge chamber. The control piece 1 runs with the expansion of the control groove 27 against the forward, fixed control pin 12.

Ninth motion phase (FIG. 3*k*):

Running of the beveled inlet of the control groove 27 onto the front, fixed control pin 12 rotates the control piece 1 relative to the control shaft 2 back into its initial rotational position. The fork pin 29 disengages from the rear edge of the expansion of fork groove 28. The core piece of the control groove 17 approaches the rear control pin 11.

Tenth motion phase (FIG. 3*l*):

The cartridge is fully introduced to the cartridge chamber and the mushroom head 20 is unlocked, while the breech block carrier 21 moves forward by the locking path. The control groove 17 with its core piece passes by the rear, fixed control pin 11 and runs with its slightly curved end onto it so that the control shaft 2 executes a slight rotation, during which the rear unlocking arm 7 engages again with the catch lever 8.

Eleventh motion phase (FIGS. 3*a* and 3*m*):

All parts have returned to their initial position. A first or additional shot can occur.

From the foregoing description, persons of ordinary skill in the art will appreciate that the disclosed cartridge feed device includes a magazine arranged beneath the barrel to accommodate several cartridges. The magazine defines a transfer station for the last of these cartridges. The transfer station is aligned roughly in the direction of the axis of the bore of the barrel. The device also includes a liftable and lowerable lifting device which is preferably controlled by the breech movement to lift a cartridge situated in the intermediate station to a feed station in which the cartridge is situated behind the cartridge chamber of the barrel. Additionally, the feed device is provided with a transfer device which causes transport of the cartridge from the transfer station to the intermediate station.

From the foregoing, it will be appreciated that the cartridge is not conveyed to the intermediate station via the longitudinal direction of the weapon as in the prior art, but is instead conveyed into the intermediate station via the transverse direction. The direction of conveyance from the transfer station to the intermediate station therefore occurs, as before, to advance the cartridge, but this direction of advance occurs transverse to the longitudinal direction.

It is already known (Browning machine gun) that cartridges can be conveyed between the transfer station, to which the cartridges are advanced transverse to the longitudinal direction, and the feed station by means of a conveyor device via an intermediate station, but this conveyance occurs primarily in the longitudinal direction of the weapon and significantly lengthens its design length.

The disclosed device is advantageous over the known Browning design in that it substantially reduces the weight and, thus, the cost of the weapon relative to that known approach.

The transfer station of the disclosed device preferably sits beneath the intermediate station so that the weapon does not acquire excessively large dimensions in the transverse direction.

Although the magazine can be implemented by any known advance device, (even if it is operated by the breech movement or by a separate drive device, for example a belt feeder), in the disclosed embodiment, the magazine is preferably equipped with a spring loaded feed device and is designed as a disk or clip magazine. The magazine can, of course, be single-row or multiple-row. A single-row clip magazine is preferred, however, because it is the most expedient in view of the resulting magazine dimensions, given the large cartridge dimensions for which the disclosed feed device is primarily intended.

In a single-row magazine, taco magazine lips are ordinarily provided to restrain the uppermost cartridge from the side. To permit removal of the uppermost cartridge in the transverse direction, at least one of the magazine lips is withdrawn from a rest position (in which it holds the uppermost cartridge) into a release position (in which the uppermost cartridge can be released for movement across its longitudinal axis). Preferably, a releasable stop is provided beneath the uppermost cartridge to prevent advance of the next cartridges.

Although persons of ordinary skill in the art will appreciate that the moveable magazine lip 16 can be spring-loaded and provided with a stop element on which a functional part of the weapon can engage in order to move the magazine lip 16 from its rest position, in the preferred embodiment, the moveable magazine lip 16 is moveable around the uppermost cartridge into a position in which it can engage between the uppermost and the subsequent cartridge in order to act simultaneously as a stop that prevents the next cartridge from advancing. In this case the moveable magazine lip 16 is preferably designed as a clamp 15 having two arms 7 that are mounted to pivot on the front and rear sides of the magazine 14.

As will be appreciated by persons of ordinary skill in the art, an element driven by the breech movement can be provided to convey the uppermost, released cartridge into the intermediate position. However, in the preferred embodiment, after lifting of the stop the feed device of the magazine acts directly on the uppermost cartridge or via the subsequent cartridge so that the uppermost cartridge is conveyed to (or almost to) the intermediate station.

The moveable magazine lip is preferably spring-loaded in the direction of its rest position so that it can be engaged beneath the uppermost cartridge in order to execute its support and/or assist in the feeding of the cartridge into the intermediate position.

While other approaches may be employed without departing from the scope or spirit of the invention, in the preferred embodiment, only one of the two magazine lips is moveable, whereas the other is fixed or designed rigid and has an inside contour complementary to the outside contour of the cartridges. The fixed magazine lip then ends above the moveable magazine lip 16 so that the cartridge is fed not vertically, but obliquely upward, transverse to its longitudinal direction. This approach facilitates the function of the moveable magazine lip 16 as a stop for the next cartridge.

As will be appreciated by persons of ordinary skill in the art, the lifting device could have spring-loaded claws that are clipped onto the cartridge situated in the intermediate station, which carry the cartridge upward into the feed station, and which are bent apart in the feed station by the breech when the breech introduces the cartridge into the cartridge chamber of the barrel without departing from the scope or the spirit of the invention. However, in the preferred embodiment, the lifting device is implemented as a feed fork 10, having two prongs 31 with which it engages beneath the cartridge situated in the intermediate station on both sides from the bottom and front, and then lifts it. This type of feed fork 10 is not only very light, but does not have an interfering effect on other functional elements of the weapon, nor does it have a tendency to be soiled, which is a particular advantage in military weapons.

As will be appreciated by persons of ordinary skill in the art, the feed fork 10 could be mounted in unequally long pivot levers to execute its motion without departing from the scope or the spirit of the invention. However, in the preferred embodiment, the feed fork 10 is displaceable in a slotted element so that even a complicated movement can be controlled in the smallest space. The fork prongs 31 are then complementary to the shape of the cartridge so that the cartridge is always aligned coaxial to the axis of the bore in the feed station.

In principle, the cartridge can only enter the feed station when the breech is open. In the generic feed device, two edges or dogs are therefore formed on the breech, which activate the entire feed device from the front or rear when the feed station is reached. For this purpose, the breech must still cover a movement path in front of and behind the feed station, which, however, is to be minimized. It is, therefore, proposed in another embodiment that the force applied by the breech during recoil (during movement through the feed station) is used to drive at least the feed fork 10 at least on its path from the intermediate station to the feed station, but is introduced to an energy accumulator and only released to the feed fork 10 when the breech is open and at rest. If the feed fork 10 is dimensioned short enough that it does not reach the rear end of the feed station, the forward movement of the breech during introduction of the cartridge into the cartridge chamber can be directly used to pivot the feed fork 10 downward in front of the breech and bring it back to the initial front position.

The energy accumulator is also preferably used to drive the feed device, whose operation can then occur with an open breech at rest. To always ensure a defined movement process and thus disturbance-free function, a catch device is provided for the breech. The catch device 8 secures the breech in its rearmost position and, in turn only, permits the drive force to be conveyed from the energy accumulator 4 to the feed device or its parts when the catch device 8 has fallen into engagement with the breech. It is, therefore, ensured that the breech 20, 21 is secured in its open position. When the feed process is at least largely completed, the feed device then controls the catch device 8 to release the breech again.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use in a firearm having a cartridge chamber, a cartridge feed device comprising:

a box magazine defining a transfer station and having an opening sized to pass a first cartridge in a direction transverse to a longitudinal axis of the first cartridge;

a movable lip associated with the magazine, the lip being movable between a rest position wherein the lip at least partially blocks the opening, and a released position wherein the lip exposes the opening sufficiently to permit the first cartridge to pass therethrough;

a magazine spring for biasing the first cartridge into the transfer station when the lip is in the rest position and for forcing the first cartridge out of the opening toward an intermediate station when the movable lip is moved from the released position to the rest position;

a feed fork for transversely lifting the first cartridge from the intermediate station to a feed station behind the cartridge chamber; and a breech for longitudinally advancing the first cartridge from the feed station into the cartridge chamber, wherein the movement of the first cartridge from the transfer station to the feed station is substantially transverse to the longitudinal axis of the cartridge.

2. A cartridge feed device as defined in claim 1 wherein the lip forms a stop precluding movement of a second cartridge into the transfer station when the lip is in the released position.

3. A cartridge feed device as defined in claim 1 wherein the lip is biased toward the rest position.

4. A cartridge feed device as defined in claim 3 wherein movement of the lip from the released position to the rest position moves the cartridge into the intermediate position.

5. A cartridge feed device as defined in claim 1 wherein the feed fork is longitudinally movable between a first position and a second position, the feed fork includes prongs for engaging the cartridge, and the prongs of the feed fork move in a vertical direction to lift the cartridge into the feed station when the feed fork moves from the first position to the second position.

6. A cartridge feed device as defined in claim 1 further comprising a control shaft and a control part for controlling the movements of the feed fork and lip.

7. A cartridge feed device as defined in claim 6 further comprising a tie rod slidably disposed within the control shaft and a compression spring disposed on the tie rod within the control shaft.

8. A cartridge feed device as defined in claim 7 wherein the tie rod is coupled to the breech; wherein the control shaft is selectively secured against longitudinal movement; wherein, during a first motion phase, the tie rod moves longitudinally with respect to the control shaft to a rearward position to thereby compress the spring from a first end; and wherein, during a second motion phase occurring after the first motion phase, the control shaft is released while the tie rod is secured in the rearward position such that the control shaft moves rearward relative to the tie rod to release the compression spring from a second end opposite the first end.

9. A cartridge feed device as defined in claim 1 wherein a stop is provided that prevents a second cartridge beneath the first cartridge from advancing out of the magazine when the magazine lip enters the released position.

10. A firearm comprising:

a box magazine defining a transfer station and having an opening sized to pass a first cartridge in a direction transverse to a longitudinal axis of the first cartridge;

a movable lip associated with the magazine, the lip being movable between a rest position wherein the lip at least partially blocks the opening, and a released position wherein the lip exposes the opening sufficiently to permit the first cartridge to pass therethrough;

a magazine spring for biasing the first cartridge into the transfer station when the lip is in the rest position and for forcing the first cartridge out of the opening toward an intermediate station when the movable lip is moved from the released position to the rest position;

a feed fork for transversely lifting the first cartridge from the intermediate station to a feed station behind the cartridge chamber; and a breech for longitudinally advancing the first cartridge from the feed station into the cartridge chamber, wherein the movement of the first cartridge from the transfer station to the feed station is substantially transverse to the longitudinal axis of the cartridge.

* * * * *

UNITED STATES PATENT AND TRADEMARK OFFICE

CERTIFICATE OF CORRECTION

PATENT NO. : 6,397,721 B1
DATED : June 4, 2002
INVENTOR(S) : Murello

It is certified that error appears in the above-identified patent and that said Letters Patent is hereby corrected as shown below:

Title page,
Insert the following:

[56] References Cited
U.S. PATENT DOCUMENTS

After "2,132,761 A * 10/1938 Robertson …….. 42/21"
insert -- 2,552,429 05/1951 F.L. Humeston …….... 42/17 --

Signed and Sealed this

Twenty-fifth Day of February, 2003

JAMES E. ROGAN
*Director of the United States Patent and Trademark Office*